US005772482A

United States Patent [19]

Duncan

[11] Patent Number: 5,772,482

[45] Date of Patent: Jun. 30, 1998

[54] DESIGNER DELUXE BOBBERS

[75] Inventor: Michael L. Duncan, 511 Glenn Rd., Greenville, S.C. 29607

[73] Assignee: Michael L. Duncan, Greenville, S.C.

[21] Appl. No.: 610,088

[22] Filed: Aug. 15, 1996

[51] Int. Cl.[6] ..... B63B 22/00

[52] U.S. Cl. ..... 441/1

[58] Field of Search ..... 441/1, 88, 136

[56] References Cited

U.S. PATENT DOCUMENTS

| | | | |
|---|---|---|---|
| 3,831,209 | 8/1974 | Clingman | 441/136 |
| 4,571,194 | 2/1986 | Kiss et al. | 441/1 |
| 4,668,201 | 5/1987 | Stark | 441/88 |
| 4,889,511 | 12/1989 | Herman | 441/88 |

*Primary Examiner*—David M. Mitchell

[57] ABSTRACT

The apparatus thus described is composed of a durable thermoplastic which does not lend itself to shrinkage or submerging in water. It can be shaped in a variety offorms of artistry. This Deluxe Bobber can be of a glo-like colorful nature for easy spotting in the water. A pin or clasp can be mounted to one side so that it can be easily attached on any clothing item or other apparels. A special form can be made for specifically attachment to a fishing rod.

1 Claim, 1 Drawing Sheet

DESIGNER DELUXE BOBBERS

TECHNICAL FIELD

This invention is a flotation device designed to keep articles of clothing or other personal items afloat for easy retrieval. More specifically, this bobber, designed in the shape of a fish is attached to a cap by a pin clasp closure. Thus when or if the cap of a fisherman or any other person on the waters falls, the cap would not sink. It will remain on the surface. The size of the fish bobber will also depend on the size of the cap or any other article to which it is attached. The fish Designer Bobber would provide buoyancy to the cap enabling the wearer to retrieve it easily.

1. Background of the Inventions

Over the years, many a Fishermen and "lover" of water-sports, can attest to the loss of a valuable item or something of sentimental value, in some body of water which was unretrievable. This loss might have been in the form of a cap, glove, sunglasses or even a fishing rod. The Designer Deluxe Bobber is a device which could provide a solution to various aquatic losses. This invention can be useful not only to the fisherman but anyone involved in water-sports.

Other devices have been invented in the past for the sole purpose of providing buoyancy to an individual's body (Stark, 1987). There is also a device designed for holding a beverage container upright to keep the beverage forn. spilling (Kiss et al., 1986). Herman, 1974, has designed a flotation device assembly comprising of a harness which holds empty bottles by various closure methods. This invention, too, was designed to provide buoyancy to an individual.

While the above mentioned devices do serve the purpose for which they were designed, they do not provide a solution to keeping an article of clothing such as a cap, buoyant. The fish, Designer Bobber can be attached to caps, scarves, gloves and other such items. It is small enough that several can be in ones possession at a time. The size can be varied to fit whatever it is to be attached to. The cost of production would be relatively inexpensive. The fish bobber is designed so that it may be seen as a decorative ornament, not only by the wearer, but also by other viewers.

2. Description of the Prior Act

A Bobber or Floater, generally known to Fishermen, is an object device used on the end or apex of a fishing rod and serves the purpose of keeping the line afloat while it is in the water. This device is compose primarily of a thermoplastic and is circular or oval in shape. When the rod is casted in the water, the Bobber attached to the end will enable the line to remain on the surface until such time the prey is apprehended or takes the bait. This is the only means for which a Bobber is used known to this claimant.

SUMMARY OF THE INVENTION

The Deluxe Designer Bobber, in the shape of a fish, is a thermoplastic device made up of the same composition as the original Bobbers used by Fishermen. This extension of the original bobber can serve as an ornamental attachment to a cap, providing buoyancy if the cap should fall in the water. This fish-shaped bobber can be made to any specified size. It can be attach to other articles with its pin clasp and hook for the same purpose of buoyancy. The afforementioned bobber is made of a thermoplastic, and through the process of "blow molding", can be formed into a hollow fish shape design. The thermoplastic is made fluid by heating and then squirted under pressure into a closed fish mold where it solidifies while cooling and is then ejected when the mold is opened. Information on plastics and molding was obtained from the fourth edition of the Encyclopedia Britannica, volume fourteen. The Designer fish Bobber has a pin clasp and hook on one side for attachment purposes. Further descriptions are given in the Preferred Embodiment section.

BRIEF DESCRIPTION OF THE DRAWINGS

This invention can be understood more clearly when described in connection with the drawings wherein.

DESCRIPTION OF THE PREFERRED EMBODIMENTS

Figure 1:
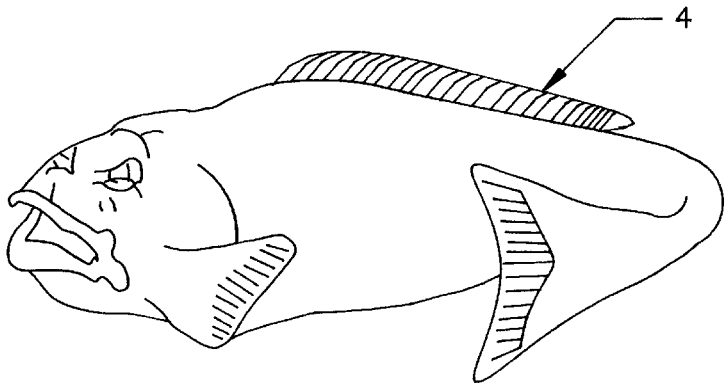
FIG. 1 shows a front view of the Designer Deluxe Bobber in the shape of a fish.
Figure 2:
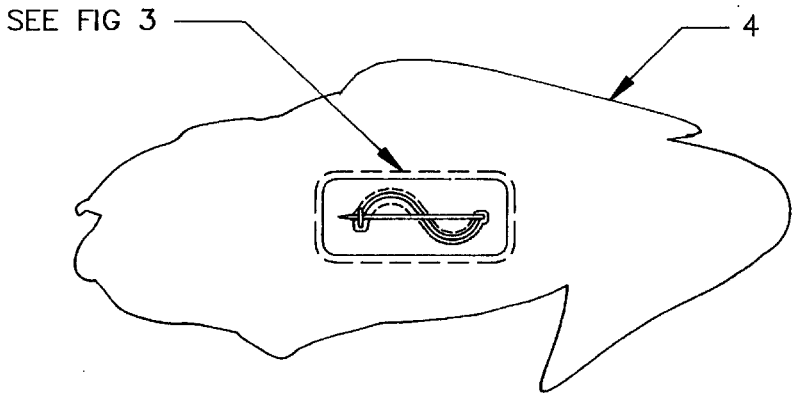
FIG. 2 shows a rear view of FIG. 1 with a pin clasp and hook mounted to it by glue or some other strong adhesive.
Figure 3:
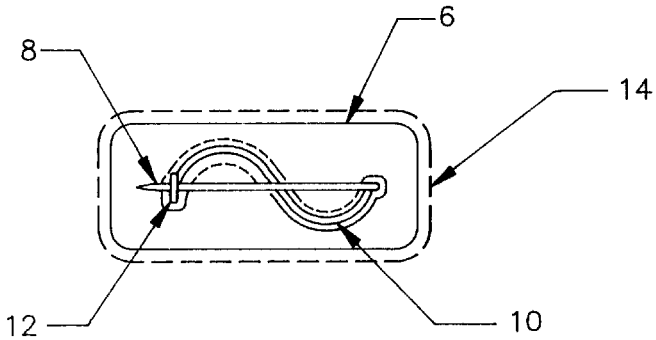
FIG. 3 shows a closed pin clasp on a flat base covered which has an outer plastic covering denoted by the broken lines.
Figure 4:
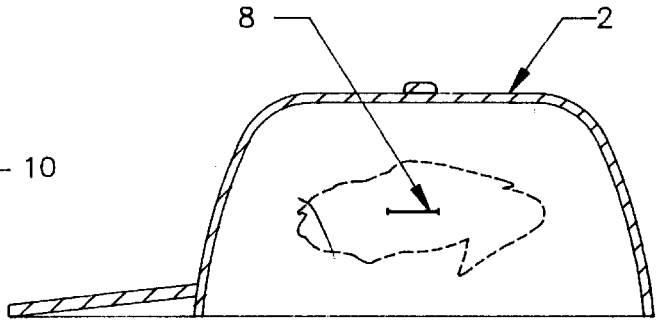
FIG. 4 shows an inside view of a cap having a pin clasp fish Designer Deluxe Bobber attached.

FIG. 1 shows a Designer Bobber shape in the form of a fish. The fish bobber 4, as shown in the drawing, can be attached to a cap 2, with a pin clasp and hook that is mounted on one side of the fish bobber FIG. 2. The pin clasp shown in FIG. 3, is an elongated piece of metal 8 that will bend over and slip under a curve-like metal hook 12. The pin clasp is attached to a rectangular shaped flat base 6, made up of another durable plastic. The bottom portion of the pin 10 is attached to the base 6 by the clear plastic covering 14 of the base. When the pin point is injected through the side of the cap 2, to the inside, it can be folded over to be ejected to the outside of the cap and thus the point of the pin can be placed under the metal hook clasp 12. FIG. 4 shows how the pin clasp attachment would look on the inside of the cap when it is worn. It shows that the fit would be comfortable and safe.

In accordance with the patent statutes, a preferred embodiment in conducive with its best mode has been formed. Whereas the realm of possibilities is limitless for this invention, the best mode makes reference only to the attach claims.

What is claimed is:

1. A deluxe designer bobber cap floatation device comprising:

a thermoplastic blow molded hollow animal shaped float of sufficient buoyancy to float a cap, the animal shaped float including a body and a head;

a rectangular mounting plate attached to the back of the float, the plate being smaller in shape than the body of the animal shaped float in order to be concealed there behind, the rectangular mounting plate also having rounded off edges;

a pin clasp having a pin with a sharp tip, a pivot, and a retaining hook, the hook retaining the sharp tip in a closed position, the clasp being attached to the mounting plate, and the pin being almost the same length as the animal shaped body; and, the clasp attaching the float to a cap in order to provide floatation to the cap and to be seen in as a decorative ornament.

* * * * *